US008544117B2

(12) United States Patent
Erb et al.

(10) Patent No.: US 8,544,117 B2
(45) Date of Patent: Oct. 1, 2013

(54) VENTILATED AIR LINER FOR A HELMET

(75) Inventors: Robert Erb, Plandome, NY (US); Raymond J. Drake, Jr., Salem, IL (US); Cortney Warmouth, Edwardsville, IL (US); Louis Anthony VanHoutin, Luka, IL (US); Vincent R. Long, St. Peters, MO (US)

(73) Assignee: Kranos IP Corporation, Litchfield, IL (US)

( * ) Notice: Subject to any disclaimer, the term of this patent is extended or adjusted under 35 U.S.C. 154(b) by 153 days.

(21) Appl. No.: 13/181,654

(22) Filed: Jul. 13, 2011

(65) Prior Publication Data

US 2013/0014313 A1 Jan. 17, 2013

(51) Int. Cl.
*A42B 3/00* (2006.01)

(52) U.S. Cl.
USPC ..... 2/411; 2/410; 2/412; 2/413; 2/414

(58) Field of Classification Search
USPC ..... 2/410–415, 455; 5/708, 655.3
See application file for complete search history.

(56) References Cited

U.S. PATENT DOCUMENTS

| | | | | | |
|---|---|---|---|---|---|
| 3,039,109 | A * | 6/1962 | Simpson | 2/413 |
| 3,713,640 | A * | 1/1973 | Margan | 267/117 |
| 4,287,613 | A * | 9/1981 | Schulz | 2/413 |
| D267,287 | S * | 12/1982 | Gooding | D29/122 |
| 5,083,320 | A * | 1/1992 | Halstead | 2/413 |
| 5,263,203 | A * | 11/1993 | Kraemer et al. | 2/413 |
| 8,069,498 | B2 * | 12/2011 | Maddux et al. | 2/414 |
| 8,201,269 | B2 * | 6/2012 | Maddux et al. | 2/9 |

* cited by examiner

*Primary Examiner* — Khoa Huynh
*Assistant Examiner* — Andrew W Collins
(74) *Attorney, Agent, or Firm* — Notaro, Michalos & Zaccaria P.C.

(57) ABSTRACT

A helmet has a ventilated shell, ventilated padding and a ventilated liner of plural cells mounted to the padding for engaging a wearer's head. The liner has top and bottom flexible sheets fused around their perimeter, the bottom sheet having plural round or oval toroidal cells and plural round or oval closed cells, the openings in the toroidal cells extending through the top sheet. Foam at least partly fills each cell. Cells under a crown of the shell are connected in a first circuit with a valve for inflating these cells and a other cells under temporal and occipital portions of the shell are connected in a second inflation circuit with a valve for inflating the second plurality of the cells. Cells under the frontal portion not being inflatable and being substantially filled with foam padding.

20 Claims, 11 Drawing Sheets

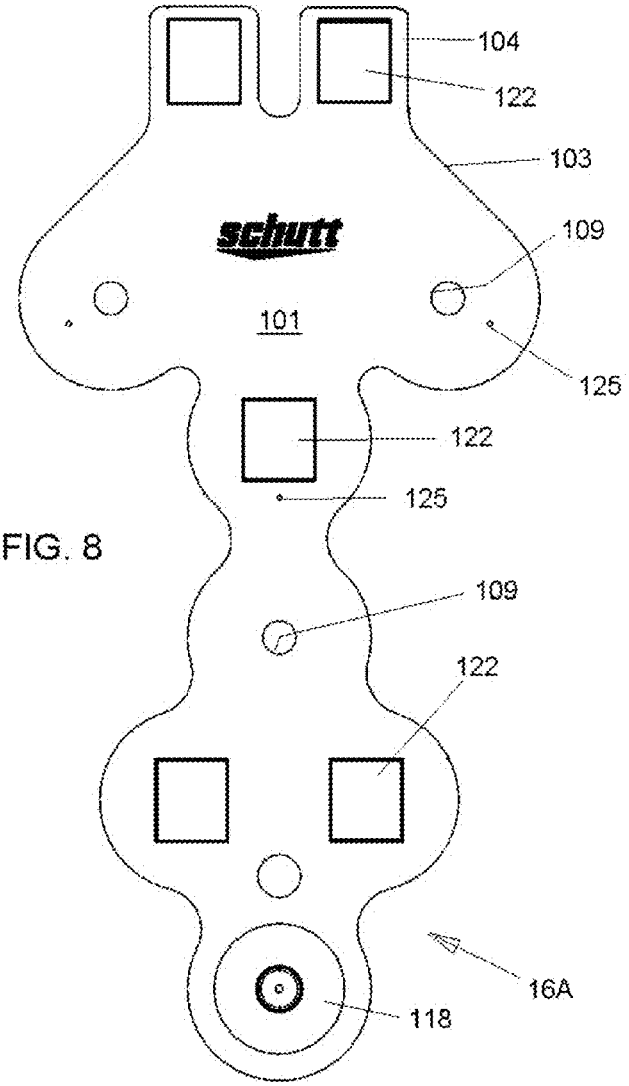
FIG. 8
FIG. 7
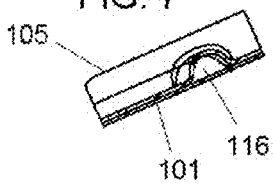
FIG. 9
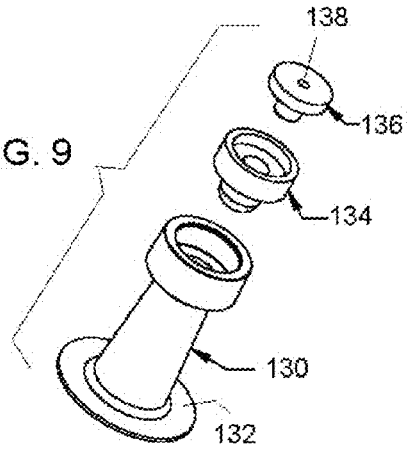

102
117
106

146
144
146
102

121
136
132
119
102
114
109
104
106
108
146
142
124
16B
104
109
104
142
124

VENTILATED AIR LINER FOR A HELMET

FIELD AND BACKGROUND OF THE INVENTION

The present invention relates generally to the field of sports headgear and, in particular, to a new and useful ventilated liner for football or other hard-shelled protective helmets.

Published U.S. patent application US2010/00299812 filed as application Ser. No. 12/476,534 on Jun. 2, 2009, discloses a protective arrangement for a sports helmet and is incorporated herein for reference for its showing of a ventilated helmet padding system for use with the present invention. Pending U.S. patent application Ser. No. 12/634,447 filed Dec. 9, 2009 also discloses a TPU foam jaw pad and is also incorporated herein for reference for its showing of additional padding for optional use with the present invention.

The following are listed as being of interest to an understanding of the present invention.

| U.S. or application No. | Inventor(s) |
|---|---|
| U.S. Pat. No. 3,761,959 | Dunning |
| U.S. Pat. No. 5,915,819 | Gooding |
| U.S. Pat. No. 4,566,137 | Gooding |
| U.S. Pat. No. 3,994,020 | Villari |
| U.S. Pat. No. 3,994,021 | Villari et al. |
| U.S. Pat. No. 3,994,022 | Villari et al. |
| U.S. Pat. No. 5,014,365 | Schultz |
| U.S. Pat. No. 4,060,855 | Rappleyea |
| U.S. Pat. No. 2,618,780 | Cushman |
| U.S. Pat. No. 3,186,004 | Carlini |
| U.S. Pat. No. 6,934,971 | Ide et al. |
| U.S. Pat. No. 5,263,203 | Kraemer et al. |
| U.S. Pat. No. 6,226,801 | Alexander et al. |
| U.S. Pat. No. 6,073,271 | Alexander et al. |
| U.S. Pat. No. 5,175,889 | Infusino |
| U.S. Pat. No. 5,720,051 | Johnson |
| U.S. Pat. No. 6,530,092 | Pope |
| U.S. Pat. No. 4,035,846 | Jencks |
| US 2003/0200598 | Jessie. |

U.S. Pat. No. 3,761,959 to Dunning teaches an inflatable liner for attachment to the interior surface of a football helmet. The inflatable liner comprises a plurality of inflatable bag-like cells designed to be situated around a wearer's head and include means for coupling at least certain of the bag-like members together for the transfer of pressurized fluid, such as air, therebetween.

U.S. Pat. No. 5,263,203 to Kraemer et al. teaches a liner for a football helmet which includes a hollow inflatable strip and a hollow flap extension located generally midway along and formed integrally with the strip, dividing the strip into left and right arms. This permits a fluid, e.g., air, to flow freely throughout the liner interior.

U.S. Pat. No. 3,994,021 to Villari et al. teaches a helmet including, a shell and two flexible liners positioned in the shell to dissipate forces applied against the helmet. The liner has fluid filled a chamber and a plurality of openings extending through the liner. The helmet also has a plurality of resilient pads. The shell also has a plurality of ventilating apertures extending through and spaced around an upper portion of the shell.

U.S. Pat. No. 4,060,855 to Rappleyea teaches a football helmet, having a flexible liner positioned in the shell to dissipate forces applied against the helmet. The liner has a pair of flexible liners or cushions. The first and second liners each have a hollow annular member and a plurality of hollow spaced spoke members extending from and communicating with the annular member of the respective liner.

U.S. Pat. No. 5,014,365 to Schulz teaches a protective helmet which includes an outer shell and an inflatable bladder mounted on the interior surface of the shell. The bladder includes a group of cells extending to the lower rear octants of the wearer's head and to the upper octants of the wearer's head. The cells are inflatable through a valve.

U.S. Pat. No. 6,934,971 to Ide et al. teaches a football helmet which includes a shock absorbing liner associated with the inner wall surface of a shell. The shock absorbing liner includes a plurality of resilient members which are adapted to absorb shock forces exerted upon the shell, and the plurality of resilient members disposed along the inner wall surface of the back and sides of the shell. The shock absorbing liners disclosed in this reference each include an inflation valve which mate with an opening or port disposed in the rear of the shell, whereby the shock absorbing liners could be inflated as desired.

U.S. Pat. No. 6,226,801 to Alexander et al. discloses a football helmet having a liner which is segmented into a multiplicity of individual cells separated by constrictions. Except for a central ring, the surface of the liner is comprised of essentially semi-cylindrical shapes extending along the loops and the reverse side of the liner is essentially flat.

Despite the known use of various types and configurations of gas inflated cells in helmet liners, a need remains for an improved ventilated helmet liner combination that both efficiently ventilates the area around the athlete's head and also contributes to the overall shock dissipating effectiveness of the helmet.

SUMMARY OF THE INVENTION

It is an object of the present invention to provide a comfort fit liner for the inside of a football or other protective helmet that is soft and perforated to provide ventilation and is used, in particularly, in conjunction with a ventilated padding made, for example of thermoplastic polyurethane or TPU, a class of polyurethane plastics, that itself is also ventilated on the top, bottom and sides of the athlete's head. This type of padding is available in helmets sold under the Schutt trademarks AIR MAXX and AIR XP. See the above-identified published patent application US2010/00299812 and pending patent application Ser. No. 12/634,447 for details about the ventilated padding in the Schutt AIR MAXX and Schutt AIR XP brand football helmets. The ventilated liner of the invention may alternatively be used with other ventilated padding, such as perforated foam or other perforated or ventilated padding in place of TPU padding to achieve the same purpose. The liner of the invention is also used with a perforated football helmet shell that is therefore also ventilated.

Another object of the invention is to keep the wearer cooler and more comfortable, and thus improve his performance. This is achieved by increased ventilation while providing a light weight liner.

Another object of the invention is to provide the liner as a set of air inflatable liner segments, each with plural round or oval toroids or closed cells in a pattern to best protect the wearer's head, and that are inflatable by the user to closely fit a wide variety of head shapes without impairing visibility through the front of the helmet shell.

A still further object of the invention is to provide a protective helmet arrangement that has a rigid shell with apertures for ventilation and a frontal, a crown, a pair of opposite temporal, and an occipital portion on its inner concave surface. Ventilated padding extends in the shell and the ventilated liner of plural cells is mounted to the padding for engaging the head of a wearer. The ventilated liner is made of a top sheet of air impermeable flexible plastic having a perimeter and a bottom sheet of air impermeable flexible plastic having a perimeter fused to the perimeter of the top sheet, the bottom sheet having plural round or oval toroidal cells with central openings and a plurality of round or oval closed cells with no openings, the openings in the toroidal cells extending through the top and bottom sheets. Foam padding at least partly fills each cell. A first plurality of the cells under the crown are connected in a first inflation circuit with a valve for inflating the first plurality of the cells and a second plurality of the cells under the temporal and occipital portions are connected in a second inflation circuit for inflating the second plurality of the cells. A third plurality of the cells under the frontal portion are not inflatable and are substantially filled with foam padding so that there is always a fixed distance between the wearer's eyes and front of the helmet shell.

In all embodiments of the invention preferable three frontal foam-filled closed or toroidal cells are not inflatable but are substantially filled with padding under top and bottom sheets so that the distance between the wearer's eyes and the front opening of the helmet shell always stays the same despite inflation of the inflatable crown, occipital and temporal cells. This insure good and constant visibility through the front of the helmet.

The various features of novelties which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 7 is a sectional view taken along line 7-7 of FIG. 5;

FIG. 8 is an outside plan view of the segment of the liner of the helmet of FIG. 5, also in a flattened state;

FIG. 9 is an exploded view of an air inflation valve for inflating the inflatable cells of the liner of the invention;

DESCRIPTION OF THE PREFERRED EMBODIMENTS

Figure 1:
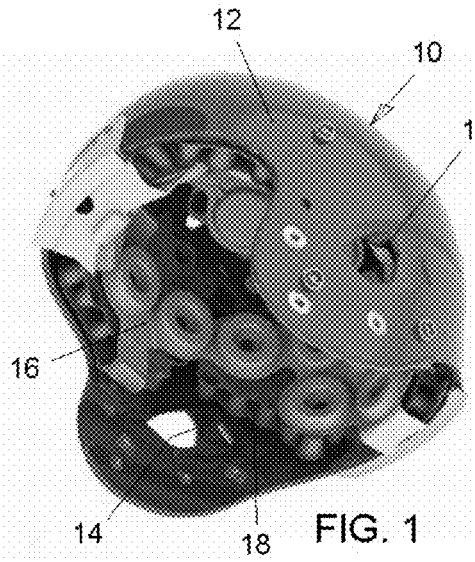
FIG. 1 is a bottom isometric view of a football helmet illustrating one embodiment of the arrangement of the present invention.
Figure 2:
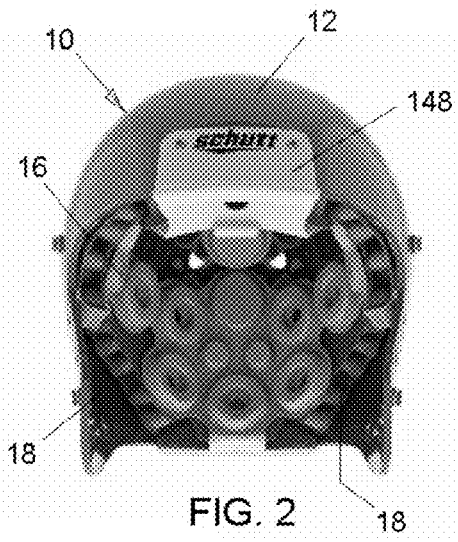
FIG. 2 is a front elevational view of the helmet of FIG. 1.
Figure 3:
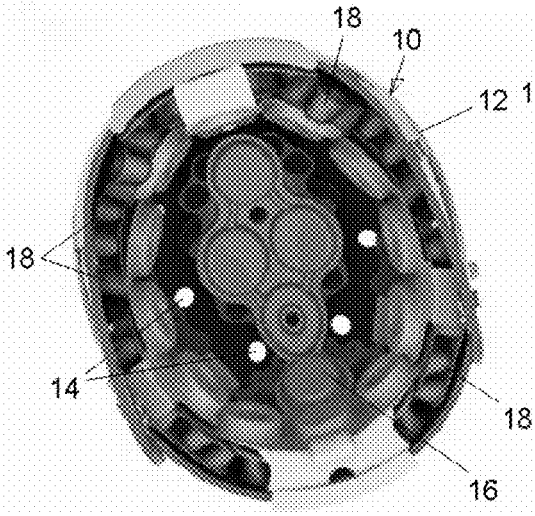
FIG. 3 is a bottom plan view of the helmet of FIG. 1.

Referring now to the drawings in which like reference numerals are used to refer to the same or functionally similar elements, FIGS. 1 to 4 show and embodiments of a protective helmet arrangement 10 according to the invention that includes a rigid ventilated helmet shell 12 adapted to cover the head of a wearer, the rigid shell being made of rigid plastics of a type that is known to those skilled in the art, such as a polycarbonate, a rigid thermoplastic or a thermosetting resin. The shell 12 is ventilated by having a plurality of spaced apertures 14 therein for allowing air to circulate from the interior of the shell, and the shell has an inner surface with a concave curvature. The concave curvature of the inner surface has a frontal portion under the liner best shown in FIG. 2, a crown portion under the liner best shown in FIG. 3, a pair of opposite temporal portions the left one being under the liner best shown in FIG. 1, and a rear occipital portion under the liner best shown in FIG. 4. The shell apertures 14 are at least in the crown portion of the shell and include two ear apertures in the respective temporal portions of the shell as well.

The arrangement importantly includes a ventilated and partly inflatable liner 16 that has plural cells that follow the concave curvature of the inner surface of the shell 12. The liner 16 is mounted to a ventilated padding 18 that is made up of a plurality of impact absorbing ventilated pads spaced apart on, and removably attached to the inner surface of the rigid shell 12. A preferred form of this ventilated padding 18 is disclosed in co-pending and here incorporated by reference published patent application US2010/00299812.

There are at least two major functions for the liner 16, one being for closely fitting the helmet arrangement to the wearer's head, and another being to add further cushioning against impact to the wearer's head. With the ventilated shell 12, ventilated padding 18 and inflatable ventilated liner 16, the wearer's head is securely engaged for proper fit and extra cushioning against impact, and importantly, air can still freely circulate to and from the wearer's head to keep the interior of the helmet arrangement from overheating.

In greater detail and with reference to FIGS. 1-14, the ventilated liner 16 of protective helmet arrangement 10 of the invention comprises the rigid shell 12 that is adapted to cover the head of a wearer, the rigid shell having an inner surface with a concave curvature and a plurality of apertures 14 at least some of which allow air to move into and out of the shell 12, the concave curvature having a frontal portion, a crown portion, a pair of opposite temporal portions and an occipital portion. The ventilated padding 18 extends along at least part of the concave curvature and is attached to the inner surface of the rigid shell 12, e.g. by glued on, aligned and mated hook and loop pads and mating male and female snap fasteners. The ventilated liner 16 follows the concave curvature and comprises a plurality of cells, the liner being mounted to the ventilated padding, e.g. also by glued on, aligned and mated hook and loop pads, for securely engaging the liner to the helmet and for securely and closely fitting head of the wearer to the helmet.

Figure 5:
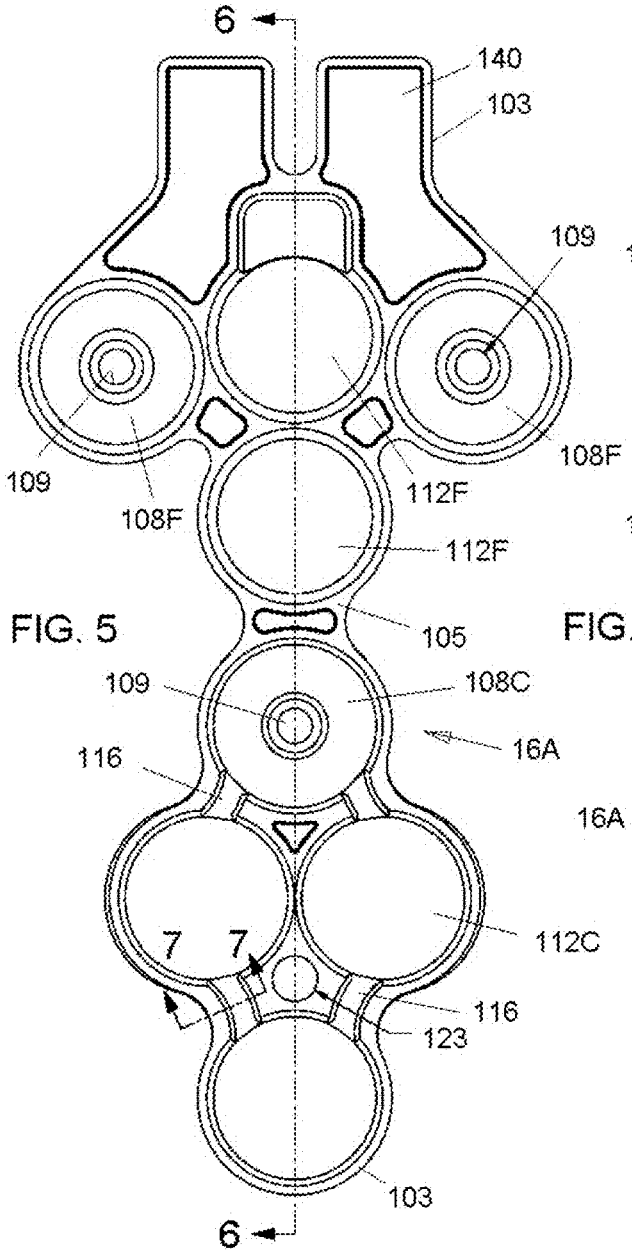
FIG. 5 is an inside plan view of a segment of the liner of the helmet of FIG. 1 showing the frontal and crown portions of the liner of the invention, in a flattened state before installation into the helmet, and for ease of illustration.
Figure 6:
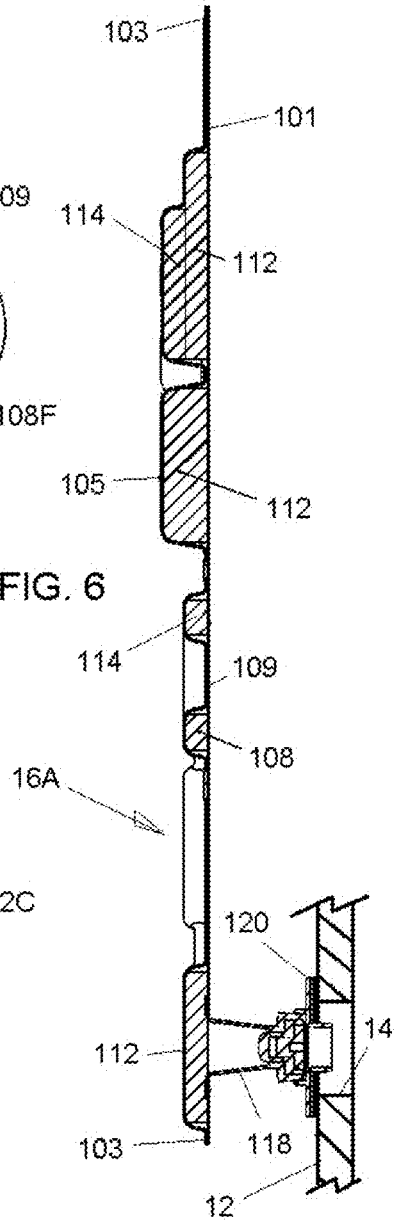
FIG. 6 is a sectional view taken along line 6-6 of FIG. 5.
Figure 10:
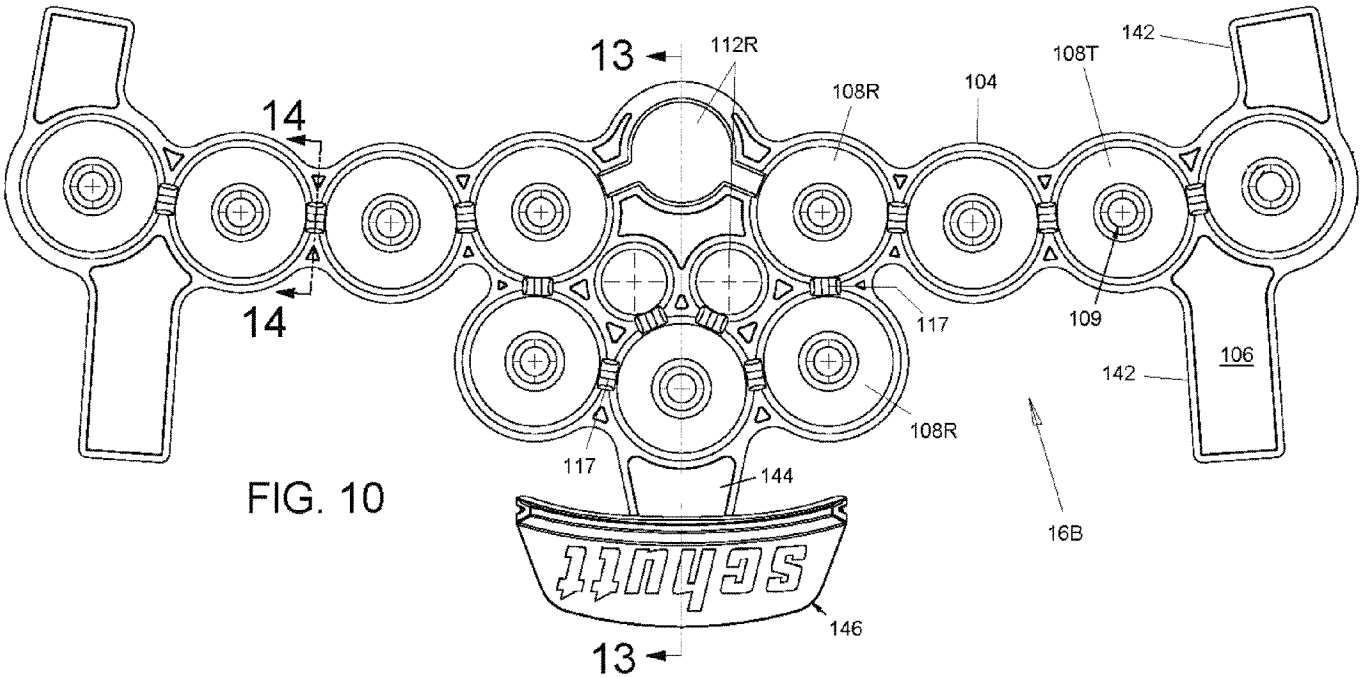
FIG. 10 is an inside plan view of a segment of the liner of the helmet of FIG. 1 showing the occipital and temporal portions of the liner, also in a flattened state.
Figure 11:
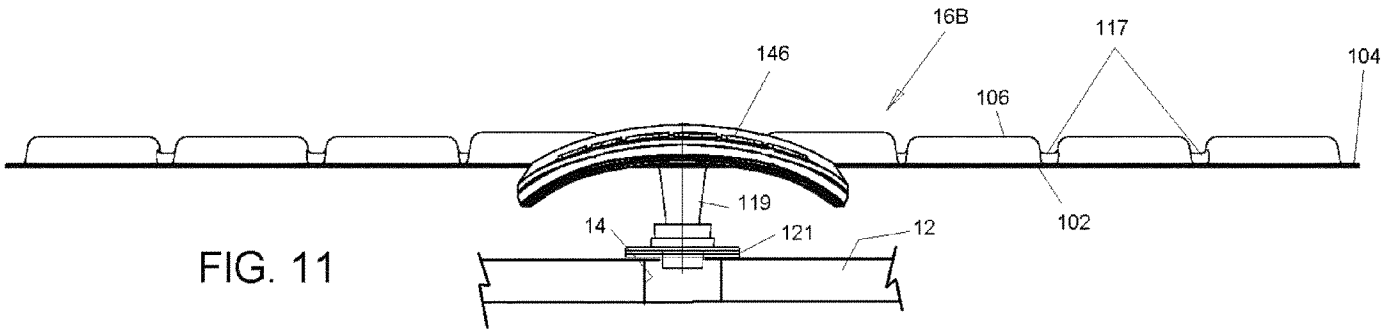
FIG. 11 is a bottom elevational view of the liner of FIG. 10.

As best illustrated in FIGS. 5-13, the ventilated liner 16 comprises two segments 16A and 16B that respectively have one top or outer sheet 101 in FIG. 6 and 102 in FIG. 11, of air impermeable flexible plastic such as PVC (polyvinylchloride) having a perimeter 103 in FIG. 6 and 104 in FIG. 11, and lying in a curved plane that is substantially parallel to and spaced inwardly of the concave curvature of the inner surface of the shell. Although shown flat in FIGS. 5-13, where the two major segments 16A and 16B of the liner 16 shown in FIGS. 5 and 10 are shown before they have been installed in the helmet, this plane is curved and follows the inside contour of the padding 18 that in turn follows the concave curvature of the inner surface of the shell 12.

Each segment 16A and 16B of the liner 16 also has a bottom or inner sheet 105 and 106 of air impermeable flexible plastic (e.g. PVC) having a perimeter that is coextensive with and is fused to the perimeters 103 and 104 of the respective top sheets 101 and 102. The bottom sheets 105 and 106 have a plurality of round or oval toroidal cells 108 with central openings 109 therethrough and a plurality of round or oval closed cells 112 with no opening therethrough, the openings 109 in the toroidal cells extending through both the top sheets 101, 102 and the bottom sheet 105, 106 as well. The liner segments 16A and 16B include plural cells that are under each of the frontal portion (cells 108F and 112F), crown portion (cells 108C and 112C), temporal portions (cells 108T), and occipital or rear portion (cells 108R) of the concave curvature. Foam padding at least partly or completely fills each cell 108 and 112 and can be made of one, two or three layers of small, medium or large pore flexible foam rubber 114, e.g. of polyethylene foam. In some areas of the liner where there are no cells but larger areas of fused top and bottom sheets, additional through-holes such as at 123 in FIG. 5 are also provided for extra ventilation. Small bleeder holes 125 are also provided through the top sheet 101 over the non-inflatable frontal cells 108F and 112F to keep them from expanding or contacting due to temperature variations but the frontal cells are otherwise sealed.

Almost all but the frontal cells 108F and 112F are air inflatable. To this end a first plurality of the cells 108C and 112C under the crown portion are connected to each other by passages 116 between the top (101) and bottom (105) sheets in a first inflation circuit for inflating the first plurality of the cells, and a second plurality of the cells 108T, 108R and 112R under the temporal and occipital portions are connected by passages 117 between the top (102) and bottom (106) sheets in a second inflation circuit for inflating the second plurality of the cells. The third plurality of the cells 108F and 112F under the frontal portion are not inflatable and are substantially filled with foam padding for maintaining constant good visibility out the front of the helmet shell as will be explained later.

A first inflation valve 118 is connected to the top sheet 101 over one of the closed cells 112 in the first plurality of cells and communicates with the first air circuit for inflating the first plurality of cells, the first inflation valve having in self-sealing air inlet opening aligned with one of the shell apertures 14 as shown in FIG. 6. A second inflation valve 119 is connected to the top sheet 102 and communicates with the second air circuit for inflating the second plurality of cells, the second inflation valve having in self-sealing air inlet opening aligned with another one of the shell apertures 14 as shown in FIG. 11. Fastening flanges 120 and 121 around the valves 118 and 119 carry glued on and mating hook and loop rings that attach the valves to the inside surface the helmet shell 12 around each aperture 14 so that the valves are kept in place for insertion of an inflation pin to pump up the inflatable cells to increase their volumes. These hook and loop fasteners also permit the liners to be removed for the helmet for replacement. Although foam is also present in each cell, the flexibility of the sheets allows the cells to expand further to a desired level.

Figures 12, 13, 14:
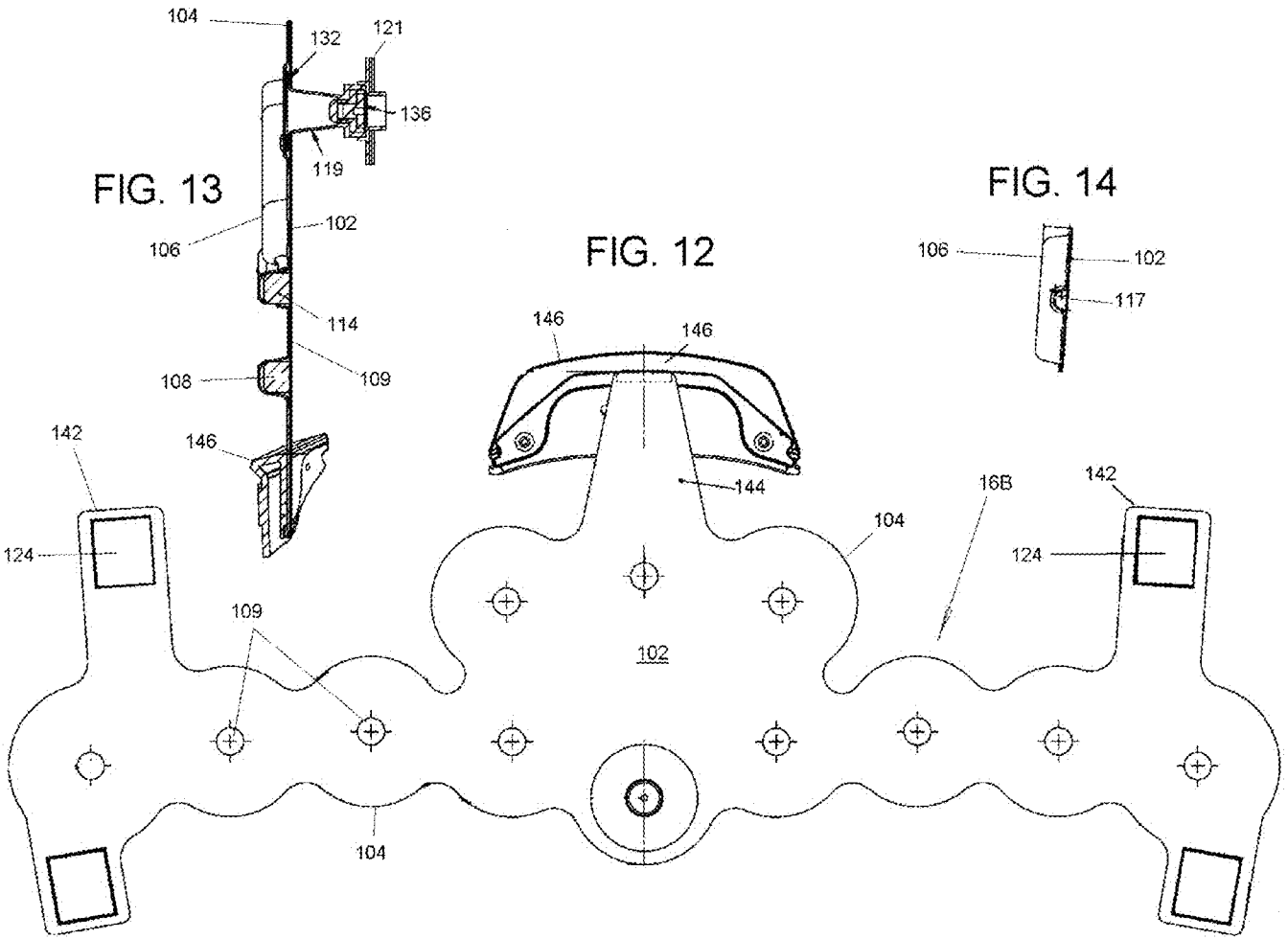
FIG. 12 is an outside plan view of the segment of liner of FIG. 10.
FIG. 13 is a sectional view taken along line 13-13 of FIG. 10.
FIG. 14 is a sectional view taken along line 14-14 of FIG. 10.
Figure 15:
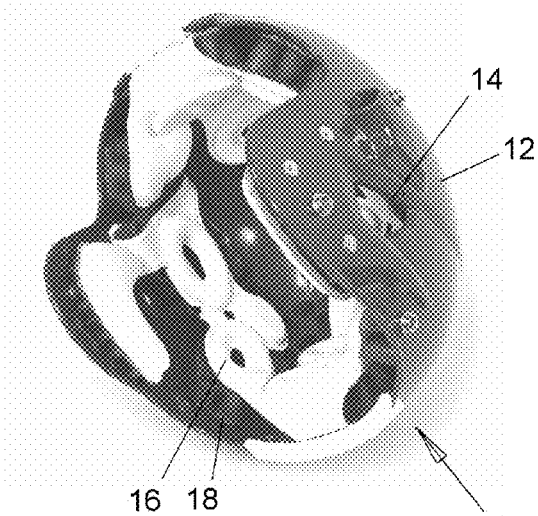
FIG. 15 is a bottom isometric view of a football helmet illustrating second embodiment of the arrangement of the present invention.
Figure 16:
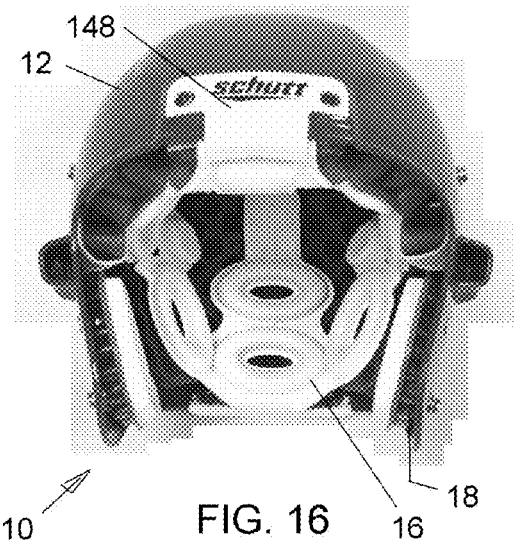
FIG. 16 is a front elevational view of the helmet of FIG. 15.
Figure 17:
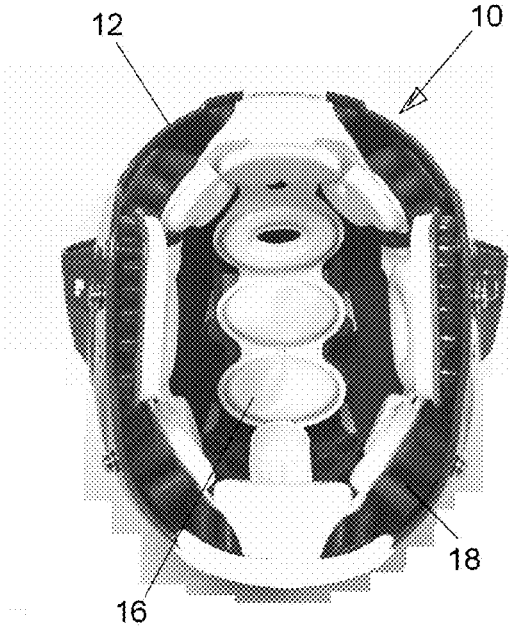
FIG. 17 is a bottom plan view of the helmet of FIG. 15.
Figure 18:
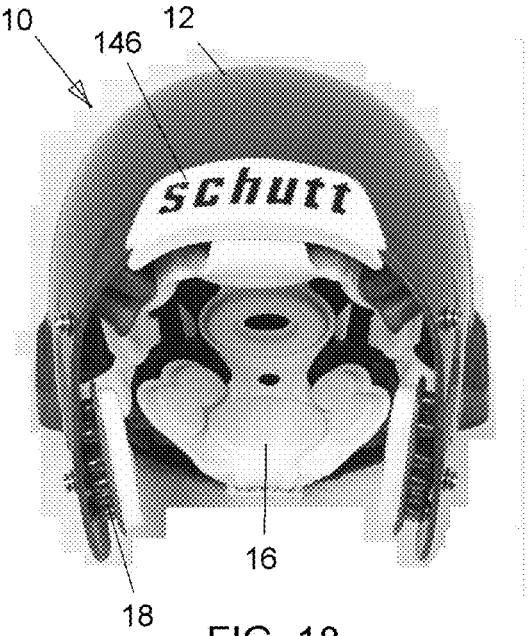
FIG. 18 is a rear elevational view of the helmet of FIG. 15.

As shown in FIG. 8, hoop or loop squares 122 are glued to the outer surface of the top sheet 101 of liner segment 16A. These squares are detachable engaged to mating loop or hook squares on the inner surface of the ventilated padding 18 to removably secure the liner segment 16A to the padding 18. As shown in FIG. 12, hoop or loop squares 124 are also glued to the outer surface of the top sheet 102 of liner segment 16B and these squares are detachable engages to mating loop or hook squares on the inner surface of the ventilated padding 18 to removably secure the liner segment 16B to the padding 18 as well. The use of hook and loop squares to connect the liner to the padding also facilitates removal and replacement of the liner 16 for refurbishing of the helmet.

Both segments 16A and 16B also include connecting tabs 140, 142 and 144, extending out of the general shape of each segment that accommodates the cells. The tabs 140 and 142 carry the hook and loop squares 122 and 124 and are long enough to be folded around and under the padding 18 to fasten to the outer surfaces of the padding to better secure the perimeters of the liner 16 to the helmet, while one central rear tab 144 extending from segment 16B is fixed to a durable plastic back bumper 146 that is connected over the rear lower lip of the helmet shell as also shown in FIG. 10. A similar front bumper 148 is connected over the front lower lip of the helmet shell 12 also shown in FIG. 2.

By using the partly inflatable liner 16 of the invention, spaces between the head of a wearer and the liner under the crown portion, the occipital portion and the temporal portions are filled by inflating the first and second plurality of cells to insure that no space is left between the forehead of the wearer and the third plurality of frontal cells so that the visibility of the wearer forwardly of the helmet shell 12 is not impaired since the distance between the wearer's eyes and the front of the shell always stay the same.

FIG. 9 shows the parts of the valve that are the same for all embodiments of the invention. These are a valve base 130 with a flange 132 that is fused to the top sheet, an inlet ring 134 pressed and glued into the inlet opening of the base 130, as a rubber or silicone self-closing inlet member 136 that contains a self-closing opening 138 of known design that can receive an air inflation pin of known design that is used with an air pump of the same types that are used to inflate footballs and other inflatable balls.

FIGS. 14-28 illustrate a second embodiment of the ventilated liner 16 of protective helmet arrangement 10 of the invention using the same reference numerals to designate functionally similar elements. As in the first embodiment, the arrangement comprises the rigid shell 12 that is adapted to cover the head of a wearer, having an inner surface with concave curvature and plural apertures 14 at least some of which allow air to move into and out of the shell 12. The concave curvature has frontal, crown, opposite temporal, and occipital portions and ventilated padding 18 extending along at least part of the concave curvature and attached to the inner surface of the rigid shell 12, e.g. by glued on, aligned and mated hook and loop pads and mating male and female snap fasteners. The ventilated liner 16 follows the concave curvature and comprises a plurality of cells, the liner being mounted to the ventilated padding, e.g. also by glued on, aligned and mated hook and loop pads, for securely engaging and fitting the helmet to the head of a wearer.

Figure 19:
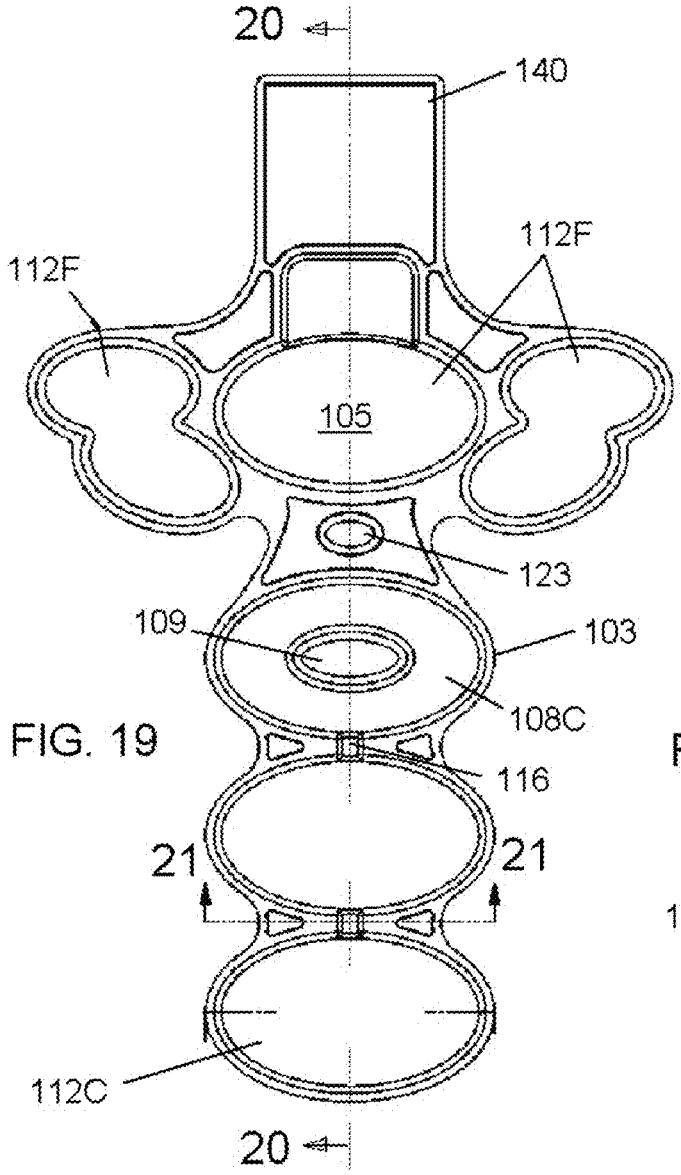
FIG. 19 is an inside plan view of a segment of the liner of the helmet of FIG. 15 showing the frontal and crown portions of the liner, in a flattened state like that of FIG. 5.
Figure 20:
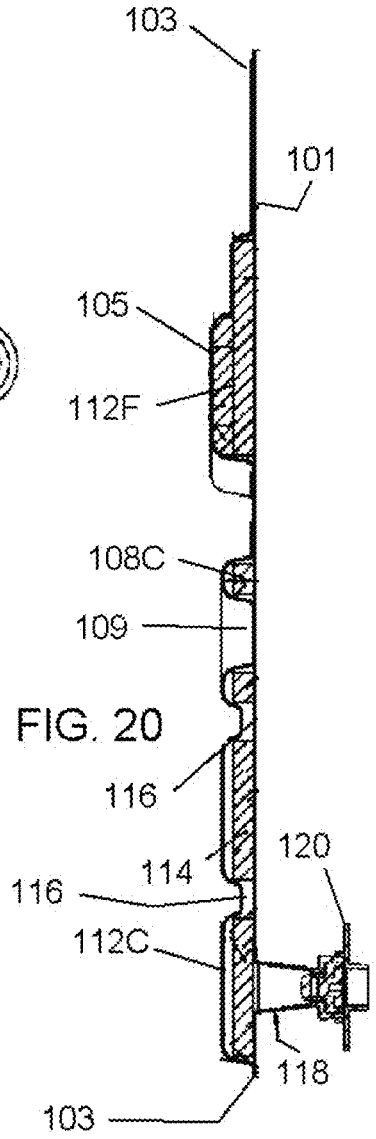
FIG. 20 is a sectional view taken along line 20-20 of FIG. 19.
Figure 23:
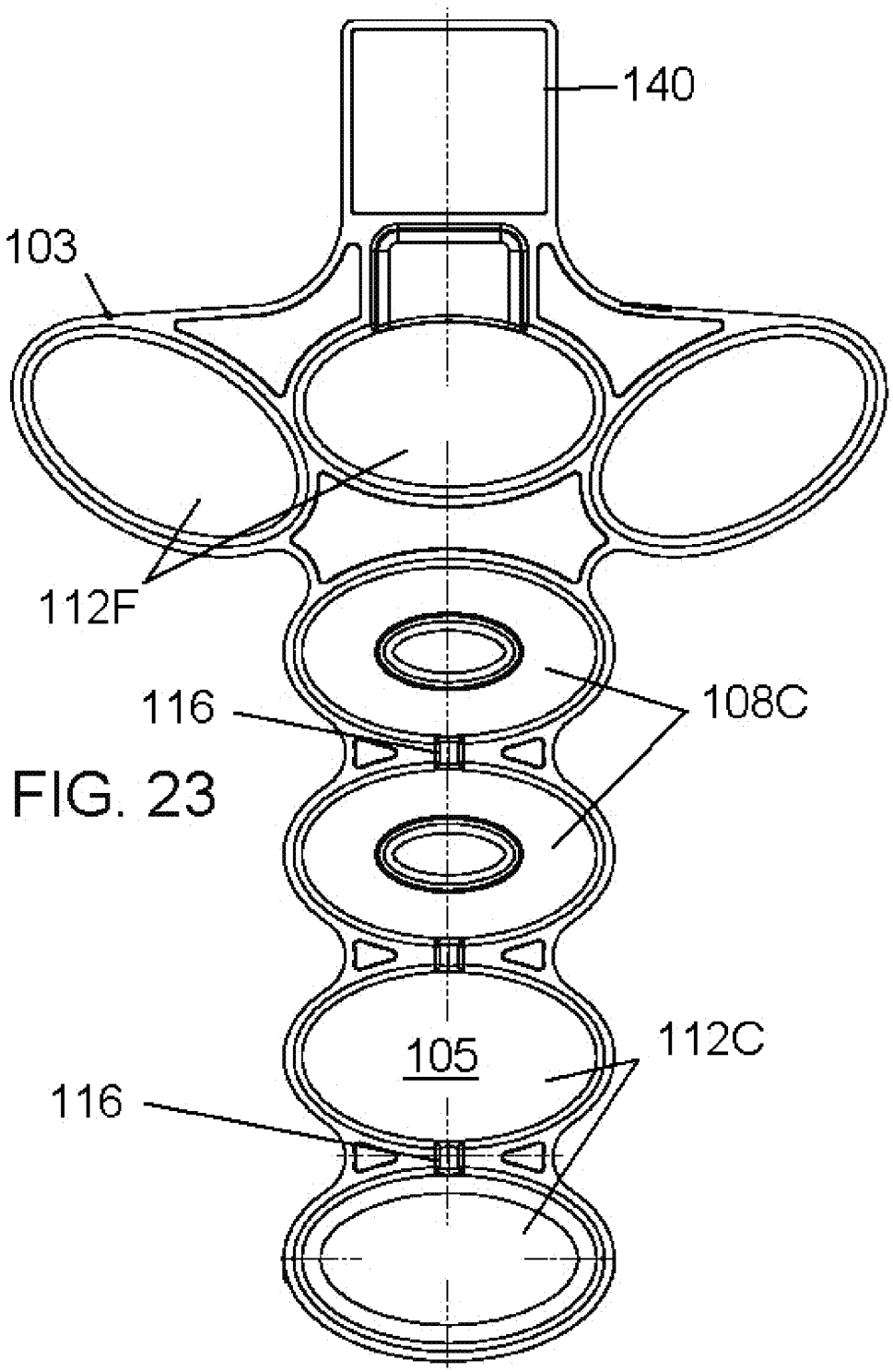
FIG. 23 is an inside plan view of a segment of a further embodiment of the liner of the helmet of FIG. 15 showing the frontal and crown portions of this further embodiment of the liner and in a flattened state.
Figure 24:
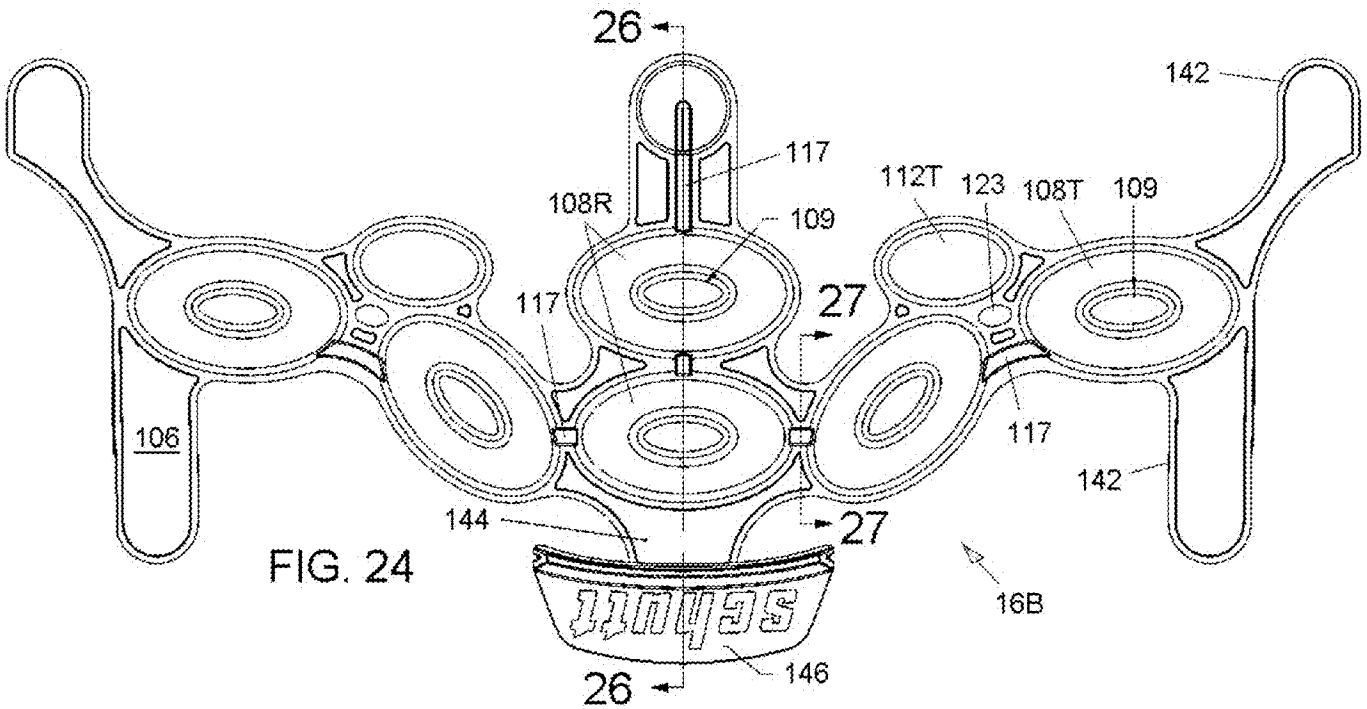
FIG. 24 is an inside plan view of a segment of the liner of the helmet of FIG. 15 showing the occipital and temporal portions of the liner, also in a flattened state.
Figure 25:
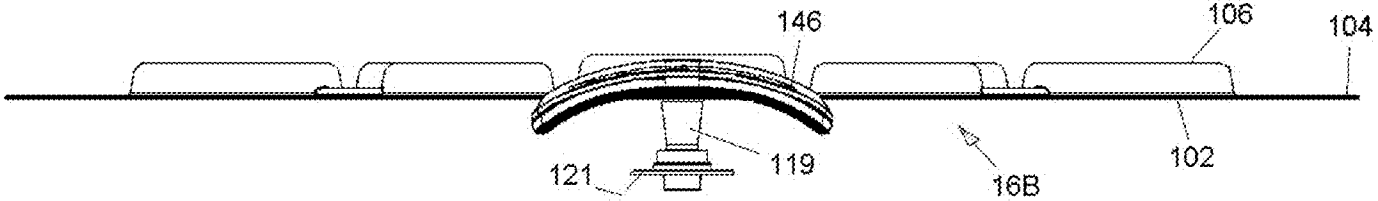
FIG. 25 is a bottom elevational view of the liner of FIG. 24.
Figure 27:
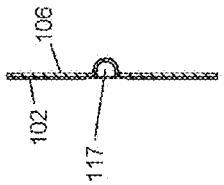
FIG. 27 is a sectional view taken along line 27-27 of FIG. 24.
Figure 26:
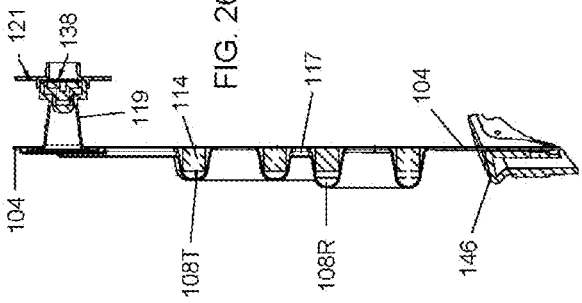
FIG. 26 is a sectional view taken along line 26-26 of FIG. 24.

As best illustrated in FIGS. 19-22 and 24-28, the ventilated liner 16 comprises two segments 16A and 16B that respectively have one top or outer sheet 101 in FIG. 20 and 102 in FIG. 25, of air impermeable flexible plastic such as PVC (polyvinylchloride) having a perimeter 103 in FIG. 20 and 104 in FIG. 25, and lying in a curved plane that is substantially parallel to and spaced inwardly of the concave curvature of the inner surface of the shell. As with FIGS. 5-14, FIGS. 19-22 and 24-28 show the two major segments 16A and 16B of the liner 16 flat, shown before they have been installed in the helmet. FIG. 23 shows a further embodiment of the segment 16C for a different sized helmet that has four rather that three crown cells 108C and 112C and all closed oval frontal cells 112F, unlike the embodiment of FIG. 19 with three crown cells 108C, 112C and two double oval frontal side cells 112F and a single oval central frontal cell 112F.

Each segment 16A or 16C and 16B of the liner 16 also has a bottom or inner sheet 105 and 106 of air impermeable flexible plastic (e.g. PVC) having a perimeter that is coextensive with and is fused to the perimeters 103 and 104 of the top sheets 101 and 102. The bottom sheets 105 and 106 have a plurality of oval toroidal cells 108 with central openings 109 therethrough and a plurality of oval closed cells 112 with no opening therethrough, the openings 109 in the toroidal cells extending through the top sheets 105, 106 as well. The liner segments include plural cells that are under each of the frontal portion (cells 112F), crown portion (cells 108C and 112C), temporal portions (cells 108T and 112T), and occipital or rear portion (cells 108R) of the concave curvature. Foam padding at least partly or completely fills each cell 108 and 112 and can be made of one, two or three layers of small, medium or large pored flexible foam rubber 114, e.g. polyethylene foam.

Almost all but the frontal cells 112F are air inflatable. To this end a first plurality of the cells 108C and 112C under the crown portion are connected to each other by passages 116 between the top (101) and bottom (105) sheets in a first inflation circuit for inflating the first plurality of the cells, and a second plurality of the cells 108T and 108R under the temporal and occipital portions are connected by passages 117 between the top (102) and bottom (106) sheets in a second inflation circuit for inflating the second plurality of the cells. The third plurality of the cells 108F under the frontal portion are not inflatable and are substantially filled with foam padding for maintaining constant good visibility.

A first inflation valve 118 is connected to the top sheet 101 over one of the closed cells 112C in the first plurality of cells and communicates with the first air inflation circuit for inflating the first plurality of cells, the first inflation valve having in self-sealing air inlet opening aligned with one of the shell apertures. A second inflation valve 119 is connected to the top sheet 102 and communicates with the second air inflation circuit for inflating the second plurality of cells, the second inflation valve having in self-sealing air inlet opening aligned with another one of the shell apertures. Fastening flanges 120 and 121 around the valves 118 and 119 carry glued on and mating hook and loop rings that attach the valves to the inside surface the helmet shell 12 around each aperture 14 so that the valves are kept in place for insertion of an inflation pin to pump up the inflatable cells to increase their volumes. These hook and loop fasteners also permit the liners to be removed for the helmet for replacement. Although foam is also present in each cell, the flexibility of the sheets allows the cells to expand further to a desired level.

Figure 22:
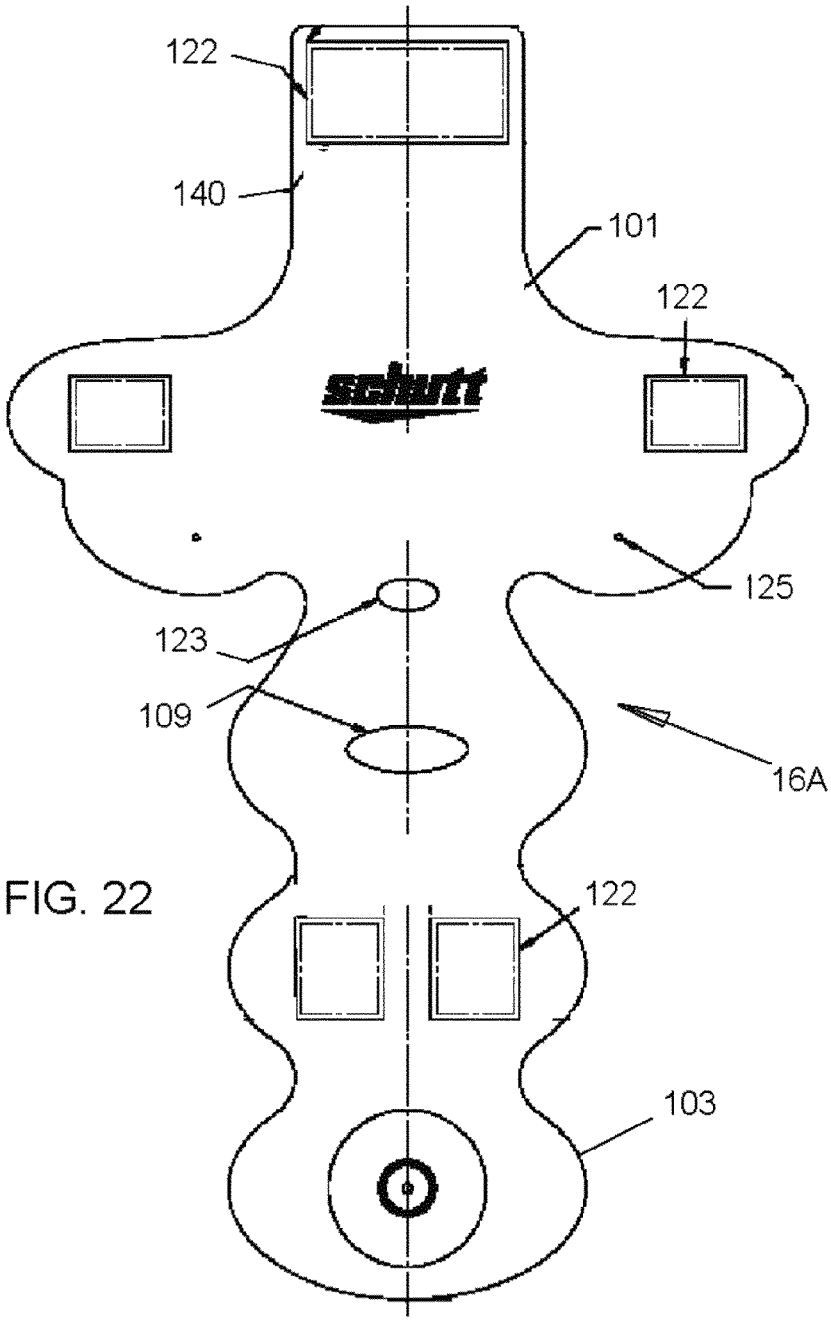
FIG. 22 is an outside plan view of the segment of the liner of the helmet of FIG. 19.
Figure 21:
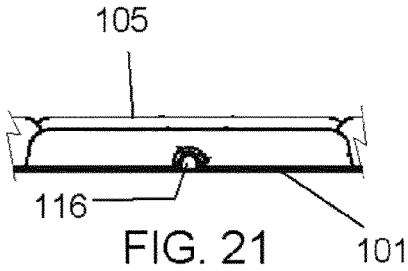
FIG. 21 is a sectional view taken along line 21-21 of FIG. 19.
Figure 28:
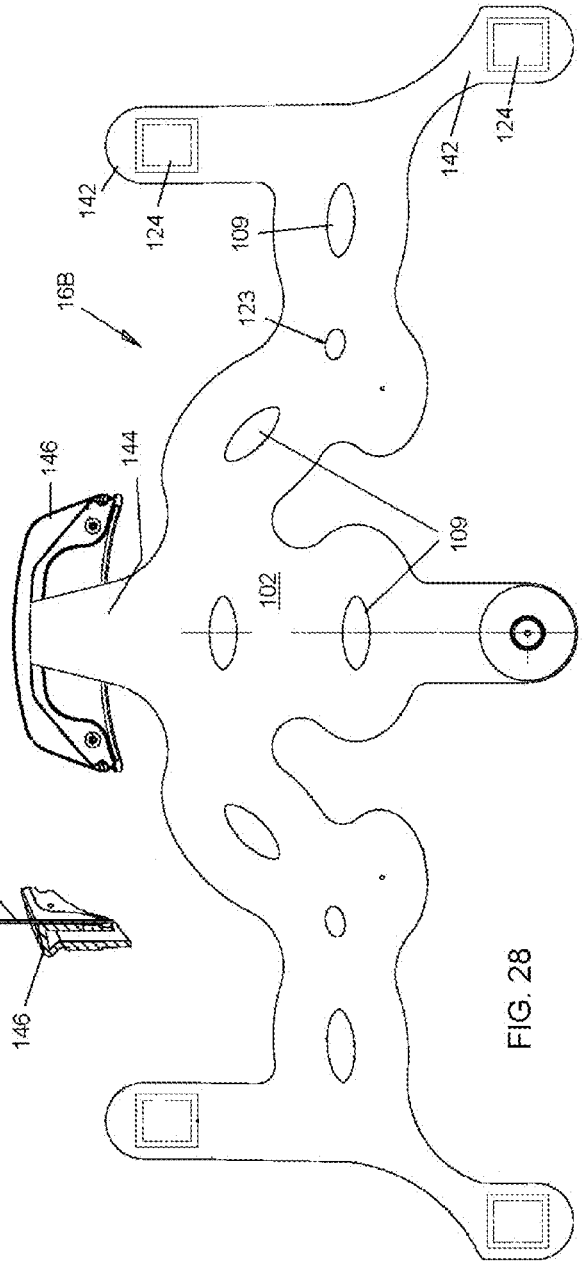
FIG. 28 is an outside plan view of the liner of FIG. 24.

As shown in FIG. 22, hoop or loop squares 122 are glued to the outer surface of the top sheet 101 of liner segment 16A. These squares are detachable engages to mating loop or hook squares on the inner surface of the ventilated padding 18 to removable secure the liner segment 16A to the padding 18. As shown in FIG. 28, hoop or loop square 124 is glued to the outer surface of the top sheet 102 of liner segment 16B and these squares are detachable engages to mating loop or hook squares on the inner surface of the ventilated padding 18 to removable secure the liner segment 16B to the padding 18 as well. This also facilitated removal and replacement of the liner 16.

Figure 4:
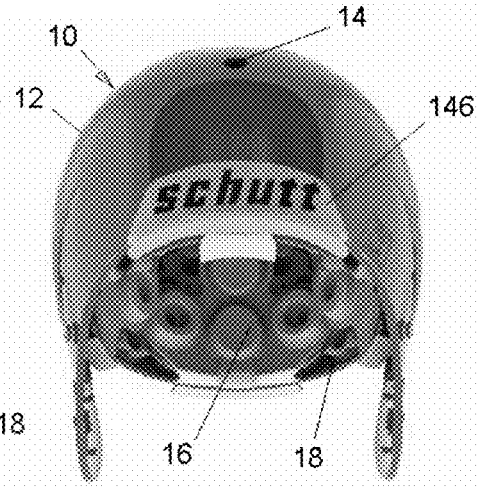
FIG. 4 is a rear elevational view of the helmet of FIG. 1.

Segments 16A, 16C and 16B also include connecting tabs 140, 142, 144 and 146, extending out of the general shape of each segment that accommodates the cells. The tabs 140 and 142 carry the hook and loop squares 122 and 124 and are long enough to be folded around and under the padding 18 to fasten to the outer surfaces of the padding to better secure the perimeters of the liner 16 to the helmet, while one central rear tab 144 extending from segment 16B is fixed to a durable plastic back bumper 146 that is connected over the rear lower lip of the helmet shell as also shown in FIG. 4. A similar front bumper 148 is connected over the front lower lip of the helmet shell 12 also shown in FIG. 16.

Although the ventilated liner 16 is best presented in two segments for easier installation into the helmet, a one-piece liner may alternatively be provided there the frontal-plus-crown portions are connected by single top and bottom sheets to the temporal-plus-occipital portions, for example by extending sheets that are in the vicinity of the valves to joint each other.

In a preferred layout of the cells that is shared by all embodiment of the invention, the first plurality of cells under the crown comprises at least three cells under the crown portion of which at least one cell is a toroidal cell 108C, the others being closed cells 112C. The second plurality of cells comprises at least three toroidal cells 108R of oval or round shape in a horizontal row under the occipital portion and at least two toroidal cells 108T in a horizontal row under each temporal portion. The third plurality of cells comprises at least three cells 108F or 112F in a horizontal row under the frontal portion. The top and bottom sheets also form the upper and lower connecting tabs 142 that extension at opposite ends of a portion of the liner having the second plurality of cells as shown in FIGS. 10 and 24, and at least one connecting tab 140 extending downwardly from a portion of the liner having the third plurality of cells as shown in FIGS. 5, 19 and 23.

In the embodiment of FIG. 5 the first plurality of cells comprises four cells 108C and 112C under the crown portion in a diamond pattern of which at least one cell is a toroidal cell. As shown in FIG. 10, the second plurality of cells comprises at least three toroidal cells 108R in a first lower horizontal row and two additional toroidal cells 108R in a second higher horizontal row under the occipital portion, and three toroidal cells 108T in the second higher horizontal row under each temporal portion. Returning to FIG. 5, the third plurality of frontal cells comprises three cells in a lower horizontal row under the frontal portion of which a center one 112F of the cells is a closed cell and the remaining two cells 108T are toroidal cells and one additional closed cell 112F above the center one of the cells. As shown in FIG. 10 the second plurality of cells also comprises two additional toroidal cells in a second higher horizontal row, one closed cell 112R between the two additional toroidal cells all under the occipital portion, and three toroidal cells in the second higher horizontal row under each temporal portion. As also shown in FIG. 10, two further smaller diameter closed but inflatable cells are also included to fill in the space between the lower and higher horizontal rows under the occipital portion of the helmet shell.

In the embodiments of FIGS. 19, 23 and 24, the first plurality of crown cells comprises at least three oval cells in a front-to-back row under the crown portion of which at least one cell is a toroidal cell 108C, the second plurality of cells comprising at least three oval toroidal cells 108R in a horizontal row under the occipital portion and at least one toroidal cell 108T under each temporal portion, and the third plurality of cells comprises at least three closed oval cells 112F in a horizontal row under the frontal portion.

While specific embodiments of the invention have been shown and described in detail to illustrate the application of the principles of the invention, it will be understood that the invention may be embodied otherwise without departing from such principles.

What is claimed is:

1. A protective helmet arrangement (10) comprising:

a rigid shell (12) adapted to cover the head of a wearer, the rigid shell having an inner surface with a concave curvature and a plurality of apertures at least some of which allow air to move into and out of the shell, the concave curvature having a frontal portion, a crown portion, a pair of opposite temporal portions and an occipital portion;

a ventilated padding (18) extending along at least part of the concave curvature and attached to the inner surface of the rigid shell (12); and a ventilated liner (16) laying along spacing inwardly of the concave curvature and comprising a plurality of cells, the liner being mounted to the ventilated padding for securely engaging the head of a wearer;

the ventilated liner comprising:

at least one top sheet (101, 102) of air impermeable flexible plastic having a perimeter (103, 104) and lying in a curved plane that is substantially parallel to and spaced inwardly of the concave curvature of the inner surface of the shell;

at least one bottom sheet (105, 106) of air impermeable flexible plastic having a perimeter fused to the perimeter of the at least one top sheet, the bottom sheet having a plurality of round or oval toroidal cells (108) with central openings (109) therethrough and a plurality of round or oval closed cells (112) with no opening therethrough, the openings (109) in the toroidal cells extending through the top and bottom sheets, the liner including plural the cells that are under each of the frontal, crown, temporal and occipital portions of the concave curvature;

foam padding (114) at least partly filling each cell;

a first plurality of the cells under the crown portion being connected by passages (116) between the top and bottom sheets in a first inflation circuit for inflating the first plurality of the cells, a second plurality of the cells under the temporal and occipital portions being connected by passages (117) between the top and bottom sheets in a second inflation circuit for inflating the second plurality of the cells, a third plurality of the cells under the frontal portion not being inflatable and being substantially filled with foam padding;

a first inflation valve connected to the top sheet over one of the closed cells in the first plurality of cells and communicating with the first inflation circuit for inflating the first plurality of cells, the first inflation valve having a self-sealing air inlet opening aligned with one of the shell apertures; and a second inflation valve connected to the top sheet and communicating with the second air circuit for inflating the second plurality of cells, the second inflation valve having a self-sealing air inlet opening aligned with another one of the shell apertures;

wherein spaces between the head of a wearer and the liner under the crown portion, the occipital portion and the temporal portions are filled by inflating the first and second plurality of cells to insure that no space is left between the head of the wearer and the third plurality of cells so that the visibility of the wearer forwardly of the helmet shell (12) is not impaired.

2. The protective helmet arrangement of claim 1, wherein the ventilated liner comprises two separate segments, a first one of the segments (16A) having the frontal and crown cells, the first valve and the first air circuit, and the second one of the segments (16B) having the temporal and occipital cell, the second valve and the second air circuit, the at least one top sheet comprising a top sheet for each of the segments and the at least one bottom sheet comprising a bottom sheet for each of the segments.

3. The protective helmet arrangement of claim 1, wherein the first plurality of cells comprises at least three cells under the crown portion of which at least one cell is a toroidal cell, the second plurality of cells comprises at least three toroidal cells in a horizontal row under the occipital portion and at least two toroidal cells in a horizontal row under each temporal portion, and the third plurality of cells comprises at least three cells in a horizontal row under the frontal portion, the top and bottom sheets also forming upper and lower connecting tabs that extension at opposite ends of a portion of the liner having the second plurality of cells, and at least one connecting tab extending downwardly from a portion of the liner having the third plurality of cells.

4. The protective helmet arrangement of claim 1, wherein the ventilated liner comprises two separate segments, a first one of the segments (16A) having the frontal and crown cells, the first valve and the first air circuit, and the second one of the segments (16B) having the temporal and occipital cell, the second valve and the second air circuit, the at least one top sheet comprising a top sheet for each of the segments and the at least one bottom sheet comprising a bottom sheet for each of the segments, the first plurality of cells comprising at least three cells under the crown portion of which at least one cell is a toroidal cell, the second plurality of cells comprising at least three toroidal cells in a horizontal row under the occipital portion and at least two toroidal cells in a horizontal row under each temporal portion, and the third plurality of cells comprising at least three cells in a horizontal row under the frontal portion.

5. The protective helmet arrangement of claim 1, wherein the first plurality of cells comprises four cells under the crown portion in a diamond pattern of which at least one cell is a toroidal cell, the second plurality of cells comprises at least three toroidal cells in a first lower horizontal row and two additional toroidal cells in a second higher horizontal row under the occipital portion, and three toroidal cells in the second higher horizontal row under each temporal portion, and the third plurality of cells comprises three cells in a lower horizontal row under the frontal portion of which a center one of the cells is a closed cell and the remaining two cell being toroidal cells and one additional closed cell above the center one of the cells, the top and bottom sheets forming upper and lower connecting tabs that extension at opposite ends of the second higher horizontal row, and at least one connecting tab extending downwardly from the third plurality of cells.

6. The protective helmet arrangement of claim 1, wherein the first plurality of cells comprises four cells under the crown portion in a diamond pattern of which at least one cell is a toroidal cell, the second plurality of cells comprising three toroidal cells in a first lower horizontal row, two additional toroidal cells in a second higher horizontal row, one closed cell between the two additional toroidal cells all under the occipital portion, and three toroidal cells in the second higher horizontal row under each temporal portion, and the third plurality of cells comprises three cells in a lower horizontal row under the frontal portion of which a center one of the cells is a closed cell and the remaining two cells are toroidal cells and one additional closed cell above the center one of the cells, the top and bottom sheets forming upper and lower connecting tabs that extension at opposite ends of the second higher horizontal row, and at least one connecting tab extending downwardly from the third plurality of cells.

7. The protective helmet arrangement of claim 1, wherein the first plurality of cells comprises at least three cells in a front-to-back row under the crown portion of which at least one cell is a toroidal cell, the second plurality of cells comprising at least three toroidal cells in a horizontal row under the occipital portion and at least one toroidal cell under each temporal portion, and the third plurality of cells comprises at least three closed cells in a horizontal row under the frontal portion, the top and bottom sheets also forming upper and lower connecting tabs that extension at opposite ends of a portion of the liner having the second plurality of cells, and at least one connecting tab extending downwardly from a portion of the liner having the third plurality of cells.

8. The protective helmet arrangement of claim 1, wherein the first plurality of cells comprises at least three oval cells in a front-to-back row under the crown portion of which at least one oval cell is a toroidal cell, the second plurality of cells comprising at least three oval toroidal cells in a horizontal row under the occipital portion and at least one oval toroidal cell under each temporal portion, and the third plurality of cells comprises at least three closed oval cells in a horizontal row under the frontal portion, the top and bottom sheets also forming upper and lower connecting tabs that extension at opposite ends of a portion of the liner having the second plurality of cells, and at least one connecting tab extending downwardly from a portion of the liner having the third plurality of cells.

9. The protective helmet arrangement of claim 1, wherein the ventilated liner comprises two separate segments, a first one of the segments (16A) having the frontal and crown cells, the first valve and the first air circuit, and the second one of the segments (16B) having the temporal and occipital cell, the second valve and the second air circuit, the at least one top sheet comprising a top sheet for each of the segments and the at least one bottom sheet comprising a bottom sheet for each of the segments, the first plurality of cells comprising four cells under the crown portion in a diamond pattern of which at least one cell is a toroidal cell, the second plurality of cells comprises at least three toroidal cells in a first lower horizontal row and two additional toroidal cells in a second higher horizontal row under the occipital portion, and three toroidal cells in the second higher horizontal row under each temporal portion, and the third plurality of cells comprises three cells in a lower horizontal row under the frontal portion of which a center one of the cells is a closed cell and the remaining two cell being toroidal cells and one additional closed cell above the center one of the cells, the top and bottom sheets forming upper and lower connecting tabs that extension at opposite ends of the second higher horizontal row, and at least one connecting tab extending downwardly from the third plurality of cells.

10. The protective helmet arrangement of claim 1, wherein the ventilated liner comprises two separate segments, a first one of the segments (16A) having the frontal and crown cells, the first valve and the first air circuit, and the second one of the segments (16B) having the temporal and occipital cell, the second valve and the second air circuit, the at least one top sheet comprising a top sheet for each of the segments and the at least one bottom sheet comprising a bottom sheet for each of the segments, the first plurality of cells comprising at least three cells in a front-to-back row under the crown portion of which at least one cell is a toroidal cell, the second plurality of cells comprising at least three toroidal cells in a horizontal row under the occipital portion and at least one toroidal cell under each temporal portion, and the third plurality of cells comprises at least three closed cells in a horizontal row under the frontal portion, the top and bottom sheets also forming upper and lower connecting tabs that extension at opposite ends of a portion of the liner having the second plurality of cells, and at least one connecting tab extending downwardly from a portion of the liner having the third plurality of cells.

11. In a protective helmet arrangement (10) having a rigid shell (12) adapted to cover the head of a wearer, the rigid shell having an inner surface with a concave curvature and a plurality of apertures at least some of which allow air to move into and out of the shell, the concave curvature having a frontal portion, a crown portion, a pair of opposite temporal portions and an occipital portion and a ventilated padding (18) extending along at least part of the concave curvature and attached to the inner surface of the rigid shell (12), the improvement comprising:

a ventilated liner (16) laying along spacing inwardly of the concave curvature and comprising a plurality of cells, the liner being mounted to the ventilated padding for securely engaging the head of a wearer;

the ventilated liner comprising:

at least one top sheet (101, 102) of air impermeable flexible plastic having a perimeter (103, 104) and lying in a curved plane that is substantially parallel to and spaced inwardly of the concave curvature of the inner surface of the shell;

at least one bottom sheet (105, 106) of air impermeable flexible plastic having a perimeter fused to the perimeter of the at least one top sheet, the bottom sheet having a plurality of round or oval cells, the liner including plural the cells that are under each of the frontal, crown, temporal and occipital portions of the concave curvature;

foam padding (114) at least partly filling each cell;

a first plurality of the cells under the crown portion being connected by passages (116) between the top and bottom sheets in a first inflation circuit for inflating the first plurality of the cells, a second plurality of the cells under the temporal and occipital portions being connected by passages (117) between the top and bottom sheets in a second inflation circuit for inflating the second plurality of the cells, a third plurality of the cells under the frontal portion not being inflatable and being substantially filled with foam padding;

a first inflation valve connected to the top sheet over one of the closed cells in the first plurality of cells and communicating with the first inflation circuit for inflating the first plurality of cells, the first inflation valve having a self-sealing air inlet opening aligned with one of the shell apertures; and a second inflation valve connected to the top sheet and communicating with the second air circuit for inflating the second plurality of cells, the second inflation valve having a self-sealing air inlet opening aligned with another one of the shell apertures;

wherein spaces between the head of a wearer and the liner under the crown portion, the occipital portion and the temporal portions are filled by inflating the first and second plurality of cells to insure that no space is left between the head of the wearer and the third plurality of cells so that the visibility of the wearer forwardly of the helmet shell (12) is not impaired.

12. The improvement of claim 11, wherein the ventilated liner comprises two separate segments, a first one of the segments (16A) having the frontal and crown cells, the first valve and the first air circuit, and the second one of the segments (16B) having the temporal and occipital cell, the second valve and the second air circuit, the at least one top sheet comprising a top sheet for each of the segments and the at least one bottom sheet comprising a bottom sheet for each of the segments.

13. The improvement of claim 11, wherein the first plurality of cells comprises at least three cells under the crown portion, the second plurality of cells comprises at least three cells in a horizontal row under the occipital portion and at least two cells in a horizontal row under each temporal portion, and the third plurality of cells comprises at least three cells in a horizontal row under the frontal portion, the top and bottom sheets also forming upper and lower connecting tabs that extension at opposite ends of a portion of the liner having the second plurality of cells, and at least one connecting tab extending downwardly from a portion of the liner having the third plurality of cells.

14. The improvement of claim 11, wherein the ventilated liner comprises two separate segments, a first one of the segments (16A) having the frontal and crown cells, the first valve and the first air circuit, and the second one of the segments (16B) having the temporal and occipital cell, the second valve and the second air circuit, the at least one top sheet comprising a top sheet for each of the segments and the at least one bottom sheet comprising a bottom sheet for each of the segments, the first plurality of cells comprising at least three cells under the crown portion, the second plurality of cells comprising at least three cells in a horizontal row under the occipital portion and at least two cells in a horizontal row under each temporal portion, and the third plurality of cells comprising at least three cells in a horizontal row under the frontal portion.

15. The improvement of claim 11, wherein the first plurality of cells comprises four cells under the crown portion in a diamond pattern, the second plurality of cells comprises at least three toroidal cells in a first lower horizontal row and two additional cells in a second higher horizontal row under the occipital portion, and three cells in the second higher horizontal row under each temporal portion, and the third plurality of cells comprises three cells in a lower horizontal row under the frontal portion of which at least a center one of the cells is a closed cell and including one additional closed cell above the center one of the cells, the top and bottom sheets forming upper and lower connecting tabs that extension at opposite ends of the second higher horizontal row, and at least one connecting tab extending downwardly from the third plurality of cells.

16. The improvement of claim 11, wherein the first plurality of cells comprises four cells under the crown portion in a diamond pattern, the second plurality of cells comprising three cells in a first lower horizontal row, two additional cells in a second higher horizontal row, one closed cell between the two additional cells all under the occipital portion, and three cells in the second higher horizontal row under each temporal portion, and the third plurality of cells comprises three cells in a lower horizontal row under the frontal portion of which at least a center one of the cells is a closed cell and one additional closed cell above the center one of the cells, the top and bottom sheets forming upper and lower connecting tabs that extension at opposite ends of the second higher horizontal row, and at least one connecting tab extending downwardly from the third plurality of cells.

17. The improvement of claim 11, wherein the first plurality of cells comprises at least three cells in a front-to-back row under the crown portion of which at least one cell is a toroidal cell, the second plurality of cells comprising at least three toroidal cells in a horizontal row under the occipital portion and at least one toroidal cell under each temporal portion, and the third plurality of cells comprises at least three closed cells in a horizontal row under the frontal portion, the top and bottom sheets also forming upper and lower connecting tabs that extension at opposite ends of a portion of the liner having the second plurality of cells, and at least one connecting tab extending downwardly from a portion of the liner having the third plurality of cells.

18. The improvement of claim 11, wherein the first plurality of cells comprises at least three oval cells in a front-to-back row under the crown portion of which at least one oval cell is a toroidal cell, the second plurality of cells comprising at least three oval toroidal cells in a horizontal row under the occipital portion and at least one oval toroidal cell under each temporal portion, and the third plurality of cells comprises at least three closed oval cells in a horizontal row under the frontal portion, the top and bottom sheets also forming upper and lower connecting tabs that extension at opposite ends of a portion of the liner having the second plurality of cells, and at least one connecting tab extending downwardly from a portion of the liner having the third plurality of cells.

19. The improvement of claim 11, wherein the ventilated liner comprises two separate segments, a first one of the segments (16A) having the frontal and crown cells, the first valve and the first air circuit, and the second one of the segments (16B) having the temporal and occipital cell, the second valve and the second air circuit, the at least one top sheet comprising a top sheet for each of the segments and the at least one bottom sheet comprising a bottom sheet for each of the segments, the first plurality of cells comprising four cells under the crown portion in a diamond pattern, the second plurality of cells comprises at least three cells in a first lower horizontal row and two additional cells in a second higher horizontal row under the occipital portion, and three cells in the second higher horizontal row under each temporal portion, and the third plurality of cells comprises three cells in a lower horizontal row under the frontal portion of which at least a center one of the cells is a closed cell and one additional closed cell above the center one of the cells, the top and bottom sheets forming upper and lower connecting tabs that extension at opposite ends of the second higher horizontal row, and at least one connecting tab extending downwardly from the third plurality of cells.

20. The improvement claim 11, wherein the ventilated liner comprises two separate segments, a first one of the segments (16A) having the frontal and crown cells, the first valve and the first air circuit, and the second one of the segments (16B) having the temporal and occipital cell, the second valve and the second air circuit, the at least one top sheet comprising a top sheet for each of the segments and the at least one bottom sheet comprising a bottom sheet for each of the segments, the first plurality of cells comprising at least three cells in a front-to-back row under the crown portion of which at least one cell is a toroidal cell, the second plurality of cells comprising at least three toroidal cells in a horizontal row under the occipital portion and at least one toroidal cell under each temporal portion, and the third plurality of cells comprises at least three closed cells in a horizontal row under the frontal portion, the top and bottom sheets also forming upper and lower connecting tabs that extension at opposite ends of a portion of the liner having the second plurality of cells, and at least one connecting tab extending downwardly from a portion of the liner having the third plurality of cells.

* * * * *